US009125508B2

(12) United States Patent
Loomis

(10) Patent No.: US 9,125,508 B2
(45) Date of Patent: Sep. 8, 2015

(54) COLLAPSIBLE TREE SYSTEM

(71) Applicant: Seasons 4, Inc., Plymouth, MA (US)

(72) Inventor: Jason Loomis, Decatur, GA (US)

(73) Assignee: Seasons 4, Inc., Toano, VA (US)

( * ) Notice: Subject to any disclaimer, the term of this patent is extended or adjusted under 35 U.S.C. 154(b) by 153 days.

(21) Appl. No.: 13/931,300

(22) Filed: Jun. 28, 2013

(65) Prior Publication Data

US 2014/0004280 A1 Jan. 2, 2014

Related U.S. Application Data

(60) Provisional application No. 61/666,864, filed on Jun. 30, 2012.

(51) Int. Cl.
*A47G 33/06* (2006.01)
*A41G 1/00* (2006.01)

(52) U.S. Cl.
CPC ..... *A47G 33/06* (2013.01); *A41G 1/007* (2013.01)

(58) Field of Classification Search
CPC ..... A41G 1/00; A41G 1/001; A41G 1/004; A41G 1/005; A41G 1/007; A47G 33/06; A47G 2033/0827; A47G 33/08
See application file for complete search history.

(56) References Cited

U.S. PATENT DOCUMENTS 1,555,568 A * 9/1925 Gustafson ..... 135/25.3
1,969,821 A * 8/1934 Saxon et al. ..... 135/26
3,677,867 A 7/1972 Westlund
3,746,601 A 7/1973 Strony
3,808,082 A 4/1974 Steiber
3,811,991 A 5/1974 Dieffenbach
3,970,834 A * 7/1976 Smith ..... 362/123
4,054,696 A 10/1977 Crownover
4,659,597 A 4/1987 Lau
4,847,123 A 7/1989 Armstead
4,968,541 A 11/1990 McCrory
5,712,002 A 1/1998 Reilly
6,422,915 B1 * 7/2002 Chen ..... 446/242
7,152,998 B2 12/2006 Rahman
7,195,216 B2 3/2007 Wang
7,267,852 B1 9/2007 Rosado
7,914,168 B2 3/2011 Oliva
2005/0048226 A1 3/2005 Gary
2011/0076425 A1 3/2011 Cheng

* cited by examiner

*Primary Examiner* — Mark Ruthkosky
*Assistant Examiner* — Julia L Rummel
(74) *Attorney, Agent, or Firm* — Craige Thompson; Thompson Patent Law

(57) ABSTRACT

Apparatus and associated methods may relate to a collapsible tree system having limbs which automatically pivot from a low-profile position while the tree is in a collapsed state to an in-use position when the tree is in an extended state. In an illustrative example, the system may include limb supports movably disposed along a central support. Movement of the limb supports closer together and further apart may cause the limbs to pivot to and from positions. For example, due to limb contact with an adjacent limb support, the limbs may be caused to pivot to the low-profile position. When no forcible contact is present between an adjacent limb support and limb, gravitational forces may permit the limbs to freely pivot to the in-use position. In an illustrative example, each limb support may include a nesting cup for receiving a proximal end of the limbs while in the stowed position.

13 Claims, 6 Drawing Sheets

COLLAPSIBLE TREE SYSTEM

CROSS-REFERENCE TO RELATED APPLICATIONS

This application claims the benefit under Title 35, United States Code, Section 119(e) of United States provisional patent application entitled "Collapsible Tree System", Ser. No. 61/666,864, which was filed on Jun. 30, 2012. The 61/666,864 application is hereby incorporated by reference into this application.

TECHNICAL FIELD

Various embodiments relate generally to artificial trees, and more particularly to artificial trees adapted to be easily erected from a compact state.

BACKGROUND

Artificial plants, such as Christmas trees are widely used in both residential and commercial environments to incorporate plants in both indoor and outdoor spaces. Artificial plants can serve many useful purposes, such as for example, providing décor for holidays and special occasions. In many instances, it is necessary to assemble and disassemble the artificial plant or tree, which may require an assembly and disassembly of many parts. Over time, the parts may become lost, which often times requires the purchase of new artificial trees or plants. It can also be time consuming to assemble and disassemble certain artificial plants and trees.

SUMMARY

Apparatus and associated methods may relate to a collapsible tree system having limbs which automatically pivot from a low-profile position while the tree is in a collapsed state to an in-use position when the tree is in an extended state. In an illustrative example, the system may include limb supports movably disposed along a central support. Movement of the limb supports closer together and further apart may cause the limbs to pivot to and from positions. For example, due to limb contact with an adjacent limb support, the limbs may be caused to pivot to the low-profile position. When no forcible contact is present between an adjacent limb support and limb, gravitational forces may permit the limbs to freely pivot to the in-use position. In an illustrative example, each limb support may include a nesting cup for receiving a proximal end of the limbs while in the stowed position.

In accordance with an exemplary embodiment, each of the limb supports may be connected in an equally spaced apart manner via one or more tethers. For example, tethers may connect adjacent limb supports and prevent the limb supports from separating beyond a predetermined distance. In an exemplary embodiment, the tethers may be formed from a flexible elongated member, such as for example a string or a cable. In an illustrative example, when the central support is moved to a collapsed state, such as for example via telescopic adjustment, the tethers may flex out of the way of the limbs to permit the limbs to pivotally seat within an adjacent nesting cup and be retained in the stowed position.

Various embodiments may achieve one or more advantages. For example, some embodiments may permit for an artificial tree system which is fully assembly and erected by simply extending the central support to an extended state. For example, when the central support is extended, the limbs may be automatically unseated from the adjacent nesting cup of the limb support via a tether pulling upward on the limbs. When the limbs are unseated from the adjacent nesting cup, the limbs may freely pivot downwards to an in-use position, such as for example a generally horizontal position relative the central support. Movement of the central support to a collapsed position may likewise cause the proximal ends of the limbs to be seated within the nesting cup of the adjacent limb support, thus moving the limbs to a more vertical position relative the vertically oriented central support.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, the collapsible tree system is briefly introduced in an extended state with reference to FIG. 1. Second, with reference to FIGS. 2A-2B, the collapsible tree system is further detailed by illustrating a transformation to a collapsed state. The discussion then turns to exemplify individual components of the collapsible tree system with reference to FIGS. 3A-3E. Next, an interconnectivity of the pole with the limb support is shown in FIGS. 4A-4B. Finally, with reference to FIGS. 5A-5B, further explanatory discussion is presented to explain functionality of the limb supports and limbs.

Figure 1:
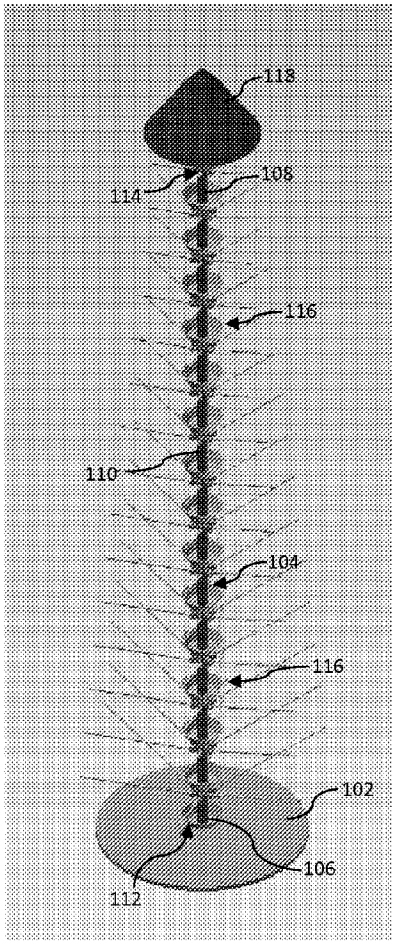
FIG. 1 depicts an exemplary collapsible tree system.

FIG. 1 depicts an exemplary collapsible tree system. In the depicted example, a collapsible tree system 100 is depicted in an extended state. The collapsible tree system 100 includes a base 102 for supporting the system 100 in an upright and self-supporting configuration. As shown in the exemplary FIG. 1, the base 102 is comprised of a circular shape. Extending from the base 102 is a central support 104 comprising a plurality of telescopically attached poles. The central support 104 includes a lower pole 106 fixed to the base 102, an upper pole 108, and one or more intermediary poles 110 which permit telescopic mobility such that the central support 104 may be extended and collapsed as desired.

A plurality of limb supports 112, 114, 116 are disposed along the central support 104. The plurality of limb supports 112, 114, 116 includes a lower support 112 disposed about the lower pole 106, an upper support 114 secured with respect to a top (e.g., distal end) of the upper pole 108, and a plurality of intermediary supports 116 slidably disposed along the central support 104. Attached to the upper end of the upper pole 108 is an upper element 118. In the example of FIG. 1, the upper element 118 is shown to have a cone-shape. The upper element 118 may have an ornamental shape in some examples, such as in the shape of a Christmas tree. The upper element 118 may have the shape of a star or angel, for example.

In some embodiments, the upper support 114 may be mechanically secured directly to the upper pole 108. For example, a removable anchor pin may extend through the pole 108, and the ends of the anchor pin may provide attachment features for supporting the upper limb support 114. In some embodiments, the upper support 114 may be mechanically secured directly to the upper element 118. For example, attachment points may be formed in the bottom side of the upper element 118 to receive hooks from which the upper limb support 114 may be suspended by a number of rods or flexible cables. In some implementations, a support collar system separate from the upper element 118 may engage (e.g., by threaded attachment to the distal end of the upper pole 108) the upper pole 108 to support the upper limb support 114 from underneath, and/or by cable suspension.

Figure 2A:
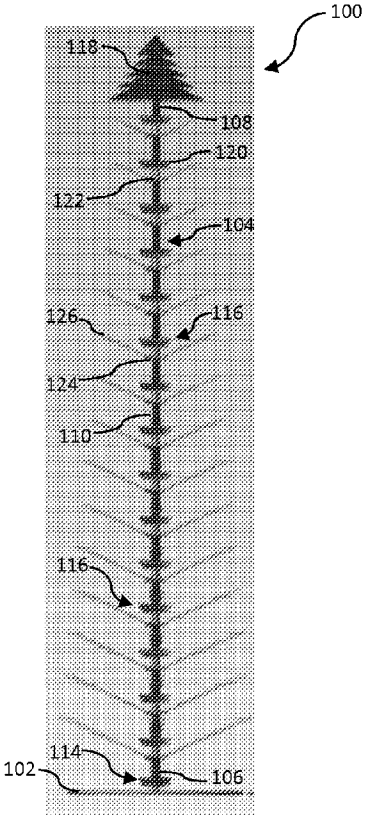
FIGS. 2A-2B depict an exemplary collapsible tree system in an extended state and a collapsed state.
Figure 2B:
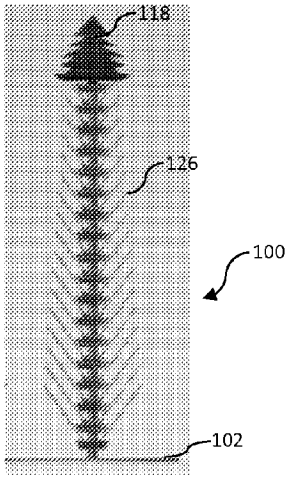

FIGS. 2A-2B depict an exemplary collapsible tree system in an extended state and a collapsed state. Each of the limb supports 112, 114, 116 includes a nesting cup 120 having a central aperture for receiving the central support 104. Extending from the bottom of the nesting cup 120 is a collar 122 which encircles the central support 104 to provide increased stability to the nesting cup 120 while being retained along the central support 104.

Attached to the collars 122 of the upper and intermediary limb supports 116, 118 are a plurality of radial supports 124 that extend outwards from the collar 122, each of which has a limb 126 extending therefrom. The limb 126 is pivotally supported by the radial supports 124 such as to permit angular deflection within a vertical plane that contains a longitudinal axis of the central support 104. For purposes of explanation, each of the radial supports 124 can be separately considered to lie along a line that forms an upward facing angle with, for example, the longitudinal axis of (or other imaginary line substantially parallel to) the central support 104. For example, when the central support 104 is extended as shown in FIG. 2A, the limbs 126 are permitted to pivot downwards to a pre-determined first angle thus being in an extended position. When the central support 104 is moved to a collapsed state as shown in FIG. 2B, the limbs 126 are forced to pivot upwards to a pre-determined second angle thus in a collapsed position.

As measured with respect to the longitudinal axis, the second angle is less than the first angle such that the limbs 126 are directed closer to a vertical orientation and, as such, closer to alignment with a longitudinal axis of the central support 104. The peripheral side walls of the nesting cup 120 are angled upwardly at an angle similar to the second angle of the limbs 126 when the central support 104 is in the fully collapsed position. The first angle is achieved by the radial supports 124 having an angled outer wall which the respective limb 126 engages when freely pivoting outwards and which stops or restricts further downward and outward movement of the limb 126.

In the depicted example, the limbs 126 also have an increasingly greater length from the uppermost limbs 126 to the lowermost limbs 126 such that the limbs 126 adjacent the lower pole 106 are longer than the limbs 126 adjacent the upper pole 108. The length of the limbs 126 monotonically increases from the upper end of the collapsible tree system 100 to the lower end of the collapsible tree system 100 to form a conical shape, such as to mimic the natural shape of a coniferous tree, for example.

In some embodiments, the limbs 126 may have a uniform radial length. In some implementations, the limbs may receive attachments to provide different types of appearances. In some other embodiments, the limbs may have lengths that form a circumference profile that alternately increases and decreases, for example, to provide a multiple peak profile distributed along the length of the central support 104. In some implementations, for example, a deciduous leaf attachment may be applied to at least some of the limbs 126. In another example, frosted white coniferous branches may be attached or rest on at least some of the limbs 126 to provide the appearance of a snow-covered pine tree.

Figure 3B:
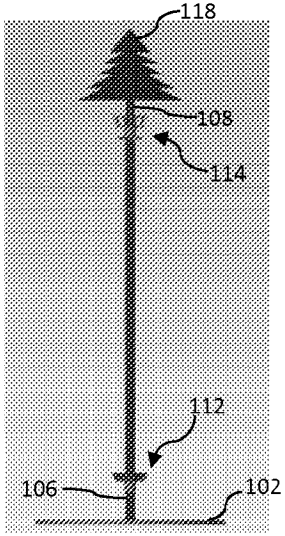
FIGS. 3A-3B depict another exemplary collapsible tree system in an extended state and a collapsed state.
Figure 3A:
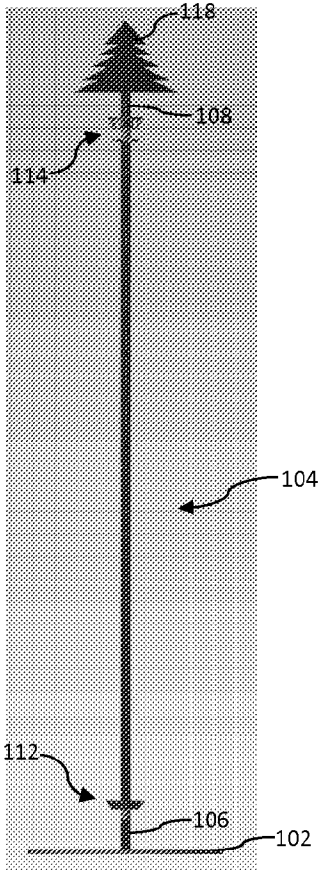
Figure 4B:
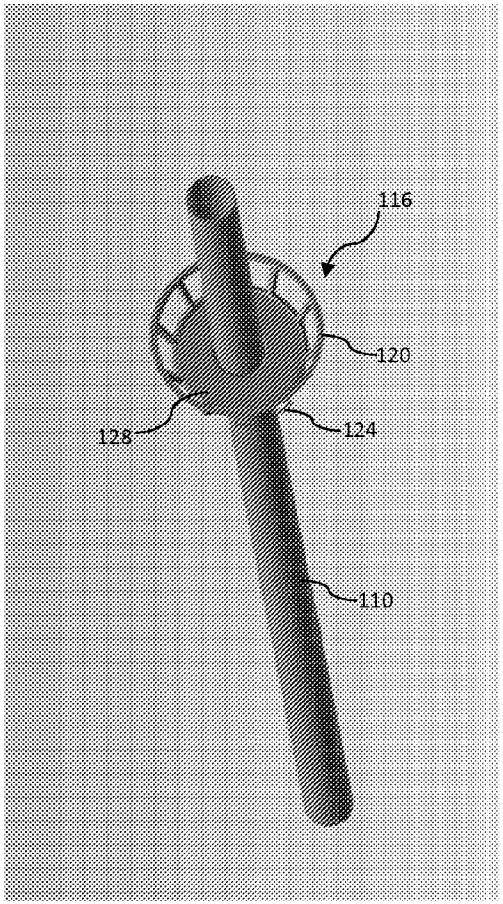
FIGS. 4A-4B depict an exemplary intermediary limb support and pole.
Figure 4A:
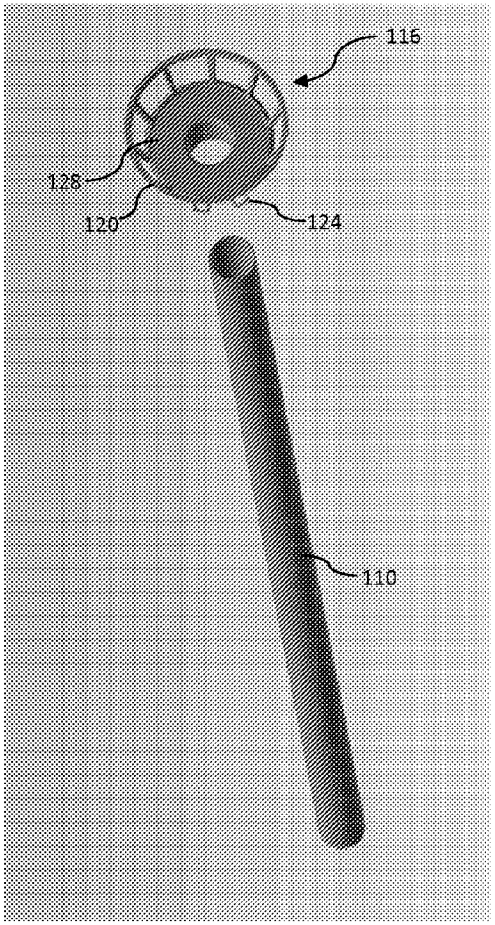

FIGS. 3A-3B depict another exemplary collapsible tree system in an extended state and a collapsed state. In FIG. 3A, the central support 104 is shown in an extended state with some details removed in order to show the fixed lower limb support 112 and upper limb support 114 in more detail. In this example, the lower limb support 112 is permanently attached to the lower pole 106 and the upper limb support 114 is permanently attached to the upper pole 108. FIG. 3B depicts the permanently attached lower limb support 112 and upper limb support 114 when the central support 104 is in the collapsed state.

Figure 3E:
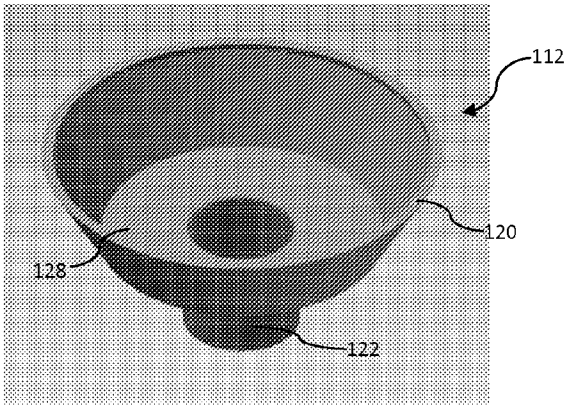
FIG. 3E depicts a perspective view of an exemplary lower limb support of the exemplary collapsible tree system depicted in FIGS. 3A-3B.
Figure 3C:
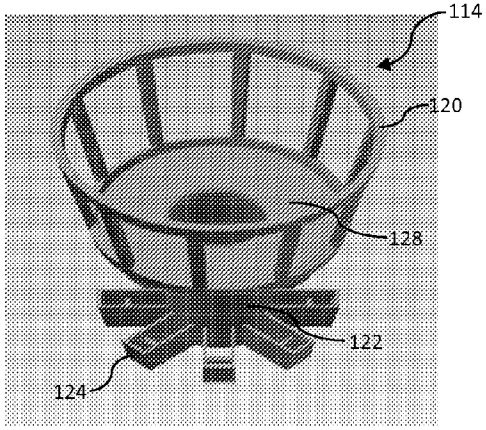
FIG. 3C depicts a perspective view of an exemplary upper limb support of the exemplary collapsible tree system depicted in FIGS. 3A-3B.

FIG. 3C depicts a perspective view of an exemplary upper limb support of the exemplary collapsible tree system depicted in FIGS. 3A-3B. As shown, the upper limb support 114 includes the nesting cup 120, collar 122, radial supports 124, and a resting surface 128. The radial supports 124 have a lesser outer diameter than the uppermost diameter of the nesting cup 120 such that the radial supports 124 may be at least partially nested or seated within the lower adjacent nesting cup 120 when the central support 104 is moved to the collapsed state. When the radial supports 124 are nested in the lower nesting cup 120, the limbs 126 engage the peripheral side wall of the nesting cup 120 to be forced to the second upward angle.

When the limbs 126 are moved to the second upward angle of the collapsed position, the respective outer ends of the limbs 126 are closer to the central support 104, which may advantageously provide, for example, a more compact circumference that may be more easily handled, stored or transported, for example. In some embodiments, the radial supports 124 of the adjacent upper limb support 114 or 116 rest upon the resting surface 128 of the adjacent lower limb support 112, 116 when the central support 104 is in the collapsed state.

Figure 3D:
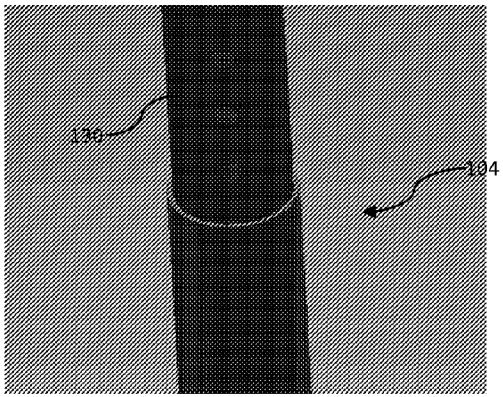
FIG. 3D depicts a magnified view of the telescopic poles of the central support of the exemplary collapsible tree system depicted in FIGS. 3A-3B.

FIG. 3D depicts a magnified view of the telescopic poles of the central support of the exemplary collapsible tree system depicted in FIGS. 3A-3B. As shown, the poles may include a latching assembly, such as holes 130 and a tab (not shown), for example.

FIG. 3E depicts a perspective view of an exemplary lower limb support of the exemplary collapsible tree system depicted in FIGS. 3A-3B. The lower limb support 112 includes the nesting cup 120 and collar 122. The lower limb support 112 does not include radial supports 124 or limbs 126 since there is no lower nesting cup 120 to receive the limbs 126 to move the limbs 126 to the collapsed position for storage, for example.

FIGS. 4A-4B depict an exemplary intermediary limb support and pole. The intermediary limb support 116 is shown to freely move along the pole independent of the central support 104.

Figure 5A:
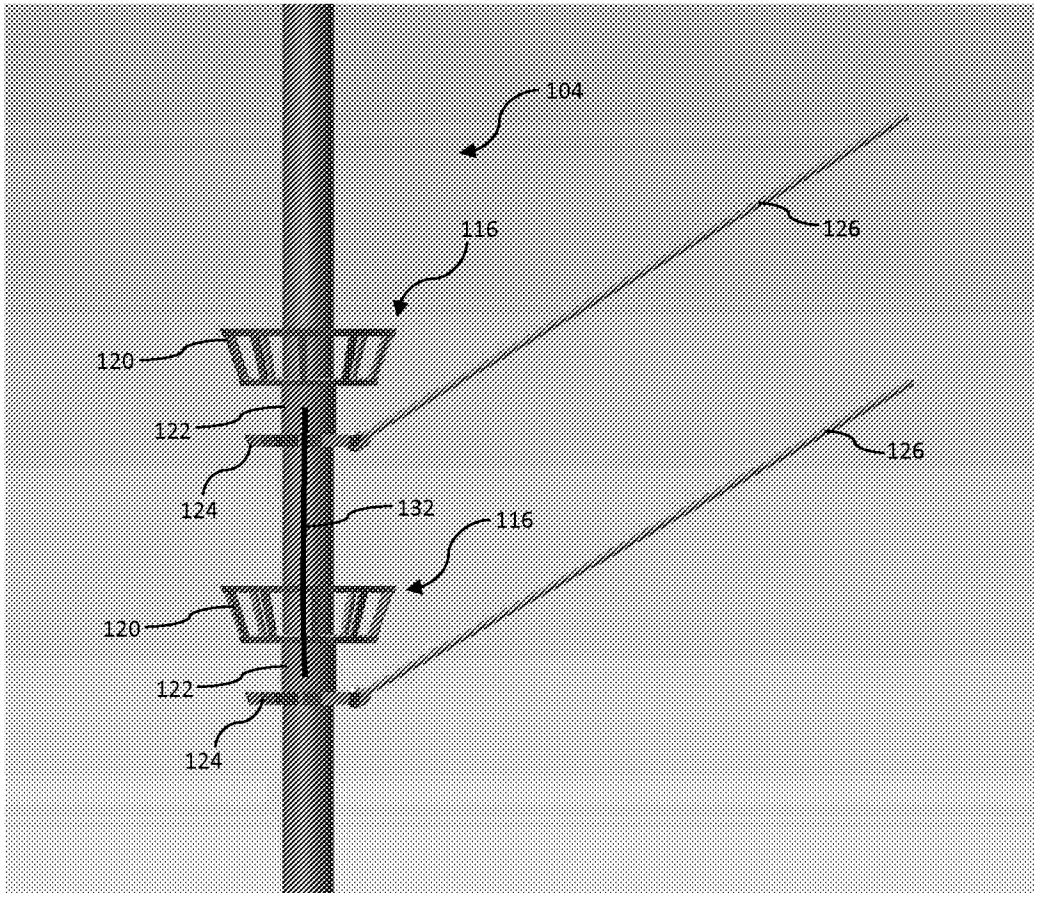
FIGS. 5A-5B depict an interconnectivity of exemplary limb supports.
Figure 5B:
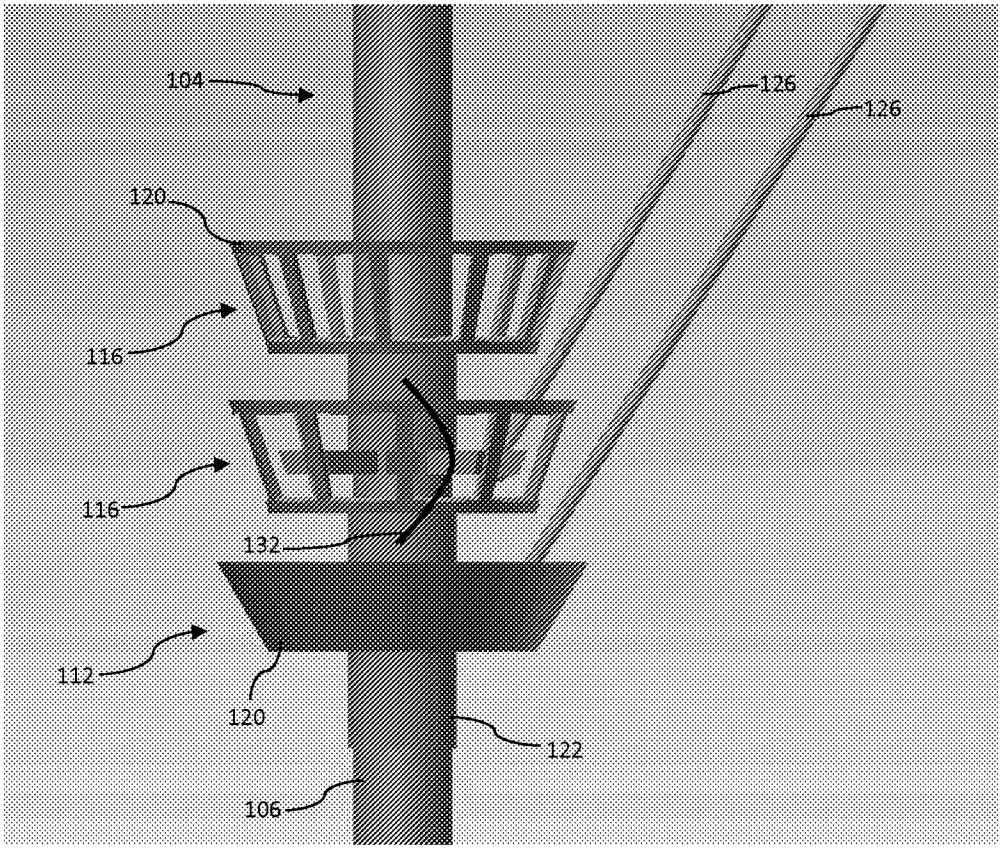

FIGS. 5A-5B depict an interconnectivity of exemplary limb supports. Each limb support 114, 116 other than the lower limb support 112, is connected by a flexible tether 132. The tether 132 retains a consistent spacing between the limb supports 112, 114, 116 when the central support 104 is in an extended, or at least partially extended, state. As such, each tether 132 is generally a predetermined length. In some examples, the tether 132 is comprised of a thin and flexible wire capable of supporting the below limb supports 116, as well as any accessories attached thereto. When the central support 104 is moved to the collapsed state, the limb supports 116 freely move along the central support 104 to be closer to the adjacent limb support 112, 114, 116 and the tether 132 flexes to permit the decrease in relative spacing between limb supports 112, 114, 116.

Although various embodiments have been described with reference to the figures, other embodiments are contemplated. For example, a motor module may be coupled to the central support to permit automated extension and retraction of the pole. In an example implementation, a controller may generate signals to retract and extend the central support to produce a time-varying tree height profile to achieve, for example, a dramatic visual effect or display. In some implementations, a self-deploying tree may be advantageous to simplify user operation and increased convenience, for example, with set up and take down between storage, display, and back to storage. Some examples may advantageously provide for storage in a compact form factor that may be substantially easier to handle due to the reduced circumference of the branches in the stowed (refracted) position. In addition, the assembly may occupy substantially reduced storage volume in the collapsed position.

In some examples, a permanently attached top-open ended case may be attached to the collapsible tree system below the lower limb support such as to contain the collapsible tree for storage or transport, for example. The case may be flexible, such as for example a duffel bag type. In some examples, the case may be extended over the collapsible tree to cover and contain the collapsible tree in either the extended state or the collapsed state.

In some examples, artificial or real tree branches may removably attach to the limbs. In some examples, artificial or real tree branches may be permanently attached to the limbs. In some examples, the tree branches may be pre-decorated with ornamental objects, such as, for example, lights.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are contemplated.

In accordance with an exemplary embodiment, the nesting cup may be omitted from the limb support such that the collars of the limb supports stack upon themselves when the collapsible tree system is in a collapsed state. It may be advantageous to directly stack the collars upon themselves to permit the central support to collapse further, such that an overall length of the central support when in a collapsed state is minimal.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. An artificial tree system, comprising:

a vertical central support configured for telescopic movement from a collapsed state to an extended state;

a plurality of nesting cups slidably disposed along said central support, wherein each of the nesting cups includes a central aperture for receiving the central support and an open end that opens towards the upper end of the central support;

a plurality of radial supports slidably disposed along said central support and each located directly above a nesting cup; and a plurality of limbs each comprising a proximal end positioned nearest the central support and a distal end positioned away from the central support, the proximal end of each limb pivotally connected to a radial support such that the limbs are radially spaced around the radial supports, wherein said plurality of limbs is adapted to pivot from a first position to a second position and wherein the distal end of each limb is located closer to the central support at said first position than at said second position;

wherein, while collapsing the central support, each radial support is received within the open end of the nesting cup located directly below it such that the pivotally-attached limbs on the radial support are caused to pivot to said first position in response to the limbs engaging and their proximal ends becoming seated within the open end of the nesting cup.

2. The artificial tree system of claim 1, wherein said plurality of limbs are adapted to pivot to said second position when said central support is in said extended state.

3. The artificial tree system of claim 1, wherein said nesting cups are retained in an equally spaced apart separation along said central support via one or more tethers.

4. The artificial tree system of claim 1, wherein said nesting cups move freely along said central support.

5. The artificial tree system of claim 1, wherein said plurality of limbs together form a conical shape along said central support when said central support is in said extended state.

6. An artificial tree system, comprising:

a vertical central support configured for telescopic movement from a collapsed state to an extended state;

a plurality of nesting cups slidably disposed along said central support, wherein each of the nesting cups includes a central aperture for receiving the central support and an open end that opens towards the upper end of the central support;

a plurality of radial supports slidably disposed along said central support and each located directly above a nesting cup; and a plurality of limbs each comprising a proximal end positioned nearest the central support and a distal end positioned away from the central support, the proximal end of each limb pivotally connected to a radial support such that the limbs are radially spaced around the radial supports, wherein said plurality of limbs is adapted to pivot from a first position to a second and wherein the distal end of each limb is closer to the central support at said first position than at said second position; and wherein, while collapsing the central support, each radial support is received within the open end of the nesting cup located directly below it such that the pivotally-attached limbs on the radial support are caused to pivot to said first position in response to the limbs engaging and their proximal ends becoming seated within the open end of the nesting cup.

7. The artificial tree system of claim 6, wherein said first position is closer to a vertical orientation than said second position when said central support is vertical.

8. The artificial tree system of claim 6, wherein said central support is adapted for movement from a collapsed state to an extended state.

9. The artificial tree system of claim 6, wherein said nesting cups are each connected by a tether.

10. The artificial tree system of claim 6, wherein each radial support is connected to the nesting cup positioned directly above each of said radial supports.

11. An artificial tree system, comprising:

a base;

a central support configured for telescopic movement from a collapsed state to an extended state;

a plurality of nesting cups slidably disposed along said central support and including an open end and a central aperture for receiving the central support;

a plurality of radial supports slidably disposed along said central support; and a plurality of limbs each comprising a proximal end positioned nearest the central support and a distal end positioned away from the central support, the proximal end of each limb pivotally connected to one of the radial supports such that the limbs are radially spaced around the radial supports, said plurality of limbs is adapted to pivot from a first position to a second position, and wherein the distal end of each limb is closer to the central support at said first position than at said second position;

wherein, when the central support is situated in a vertical orientation with the base positioned at the bottom of the central support, the open end of each nesting cup opens toward the upper end of the central support, each radial support is located directly above a nesting cup, and, while collapsing the central support, each radial support is received within the open end of the nesting cup located directly below it such that the pivotally-attached limbs on the radial support are caused to pivot to said first position in response to the limbs engaging and their proximal ends becoming seated within the open end of the nesting cup.

12. The artificial tree system of claim 11, wherein said first position is closer to a vertical orientation than said second position when said central support is vertical.

13. The artificial tree system of claim 11, wherein said plurality of limb supports are positioned closer together in said collapsed state of said central support than in said extended state.

* * * * *